US009547261B2

(12) United States Patent
Uno

(10) Patent No.: US 9,547,261 B2
(45) Date of Patent: Jan. 17, 2017

(54) IMAGE FORMING APPARATUS

(71) Applicant: KYOCERA Document Solutions Inc., Osaka (JP)

(72) Inventor: Koji Uno, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 14/936,218

(22) Filed: Nov. 9, 2015

(65) Prior Publication Data

US 2016/0132015 A1 May 12, 2016

(30) Foreign Application Priority Data

Nov. 12, 2014 (JP) ..... 2014-229873

(51) Int. Cl.

| | |
|---|---|
| ***G03G 21/00*** | (2006.01) |
| ***G03G 15/16*** | (2006.01) |
| ***G03G 15/01*** | (2006.01) |

(52) U.S. Cl.

CPC ..... *G03G 15/161* (2013.01); *G03G 15/0136* (2013.01); *G03G 21/00* (2013.01); *G03G 21/0035* (2013.01)

(58) Field of Classification Search

CPC .. G03G 21/0035; G03G 21/00; G03G 15/161; G03G 15/0136

See application file for complete search history.

(56) References Cited

U.S. PATENT DOCUMENTS

| | | | | |
|---|---|---|---|---|
| 5,991,569 | A * | 11/1999 | Sugihara | G03G 15/0126 399/111 |
| 8,879,946 | B2 | 11/2014 | Watanabe | |
| 2006/0245782 | A1 * | 11/2006 | Hirai | G03G 15/168 399/101 |

(Continued)

FOREIGN PATENT DOCUMENTS

| | | | |
|---|---|---|---|
| JP | 2007183330 | A | 7/2007 |
| JP | 2012-220634 | A | 11/2012 |
| JP | 2013130628 | A | 7/2013 |

OTHER PUBLICATIONS

Notice of Reasons for Refusal mailed by Japan Patent Office on Aug. 23, 2016 in the corresponding Japanese patent application No. 2014-229873.

*Primary Examiner* — Ryan Walsh
(74) *Attorney, Agent, or Firm* — IP Business Solutions, LLC

(57) ABSTRACT

An image forming apparatus includes an image forming unit, an intermediate transfer belt, a brush roller, a drive mechanism, a contact control mechanism, and an operation control unit. The image forming unit includes a photoconductor drum, and forms a toner image on an outer circumferential surface of the photoconductor drum. The operation control unit is configured to perform a cleaning mode including cleaning the brush roller while an image forming operation is not being performed, cause the contact control mechanism to set the photoconductor drum and the intermediate transfer belt to the non-contact phase in the cleaning mode, and cause the drive mechanism, in the non-contact phase, to drive the brush roller to rotate at a rotation speed higher than a rotation speed of the brush roller in the image forming operation, and drive the intermediate transfer belt.

8 Claims, 16 Drawing Sheets

(56) References Cited

U.S. PATENT DOCUMENTS

| | | | | |
|---|---|---|---|---|
| 2007/0212139 | A1* | 9/2007 | Sugiura | G03G 21/0035 399/353 |
| 2008/0187361 | A1* | 8/2008 | Sakagawa | G03G 15/0258 399/176 |
| 2010/0329721 | A1* | 12/2010 | Kobayashi | G03G 21/0058 399/71 |
| 2012/0257910 | A1* | 10/2012 | Watanabe | G03G 15/0189 399/129 |

* cited by examiner

Fig.11

| | PRINTING RATE | INITIAL STAGE | 100K | 200K | 300K | 400K | 500K | 600K |
|---|---|---|---|---|---|---|---|---|
| COMPARATIVE EXAMPLE 1 | 5% | ○ | ○ | ○ | ○ | ○ | ○ | ○ |
| | 20% | ○ | ○ | △ | × | × | × | × |
| WORKING EXAMPLE | 5% | ○ | ○ | ○ | ○ | ○ | ○ | ○ |
| | 20% | ○ | ○ | ○ | ○ | ○ | ○ | △ |

Fig.15A

| CONDITIONS FOR CLEANING MODE | LINEAR SPEED (mm/s) | WHOLE-LIFE NUMBER OF SHEETS (SHEETS) | PRINTING DISTANCE PER SHEET (mm/SHEET) | DISTANCE BETWEEN ONE SHEET AND ANOTHER (mm/SHEET) | WHOLE-LIFE DISTANCE (mm) | DRIVING TIME OF FUR BRUSH IN CLEANING OPERATION (s) | DISTANCE COVERED IN LINKAGE WITH CLEANING OF FUR BRUSH (mm) | IMPACT RATE OF FUR BRUSH CLEANING ON LIFE SPAN OF PHOTOCONDUCTOR DRUM |
|---|---|---|---|---|---|---|---|---|
| NON-CONTACT C DRUM, M DRUM, Y DRUM, Bk DRUM (COMPARATIVE EXAMPLE 2) | 393 | 600000 | 210 | 60 | 162000000 | 40 | 9432000 | 5.8% |
| THREE-COLOR NON-CONTACT C DRUM, M DRUM, Y DRUM (EMBODIMENT 1) | 393 | 600000 | 210 | 60 | 162000000 | 0 | 0 | 0.0% |

Fig.15B

| CONDITIONS FOR CLEANING MODE | LINEAR SPEED (mm/s) | WHOLE-LIFE NUMBER OF SHEETS (SHEETS) | PRINTING DISTANCE PER SHEET (mm/SHEET) | DISTANCE BETWEEN ONE SHEET AND ANOTHER (mm/SHEET) | WHOLE-LIFE DISTANCE (mm) | DRIVING TIME OF FUR BRUSH IN CLEANING OPERATION (s) | DISTANCE COVERED IN LINKAGE WITH CLEANING OF FUR BRUSH (mm) | IMPACT RATE OF FUR BRUSH CLEANING ON LIFE SPAN OF PHOTOCONDUCTOR DRUM |
|---|---|---|---|---|---|---|---|---|
| THREE-COLOR NON-CONTACT Bk DRUM (EMBODIMENT 1) | 393 | 600000 | 210 | 60 | 162000000 | 40 | 9432000 | 5.8% |
| FOUR-COLOR NON-CONTACT C DRUM, M DRUM, Y DRUM, Bk DRUM (EMBODIMENT 3) | 393 | 600000 | 210 | 60 | 162000000 | 20 | 4716000 | 2.9% |

IMAGE FORMING APPARATUS

INCORPORATION BY REFERENCE

This application claims priority to Japanese Patent Application No. 2014-229873 filed on Nov. 12, 2014, the entire disclosure of which is incorporated herein by reference.

BACKGROUND

The present disclosure relates to an image forming apparatus, and more particularly to a technique of collecting residual toner remaining on an outer circumferential surface of an intermediate transfer belt.

Image forming apparatuses are known that include image forming subunits of different colors aligned so as to oppose an intermediate transfer belt, to superpose toner images of the respective colors on the intermediate transfer belt thereby forming a color image, and to transfer the color image onto a recording sheet via a secondary transfer roller thus forming an image on the recording sheet. The image forming apparatus thus configured includes a brush roller for collecting residual toner remaining on the outer circumferential surface of the intermediate transfer belt, after the color image is transferred onto the recording sheet.

SUMMARY

In an aspect, the disclosure proposes further improvement of the foregoing technique.

The disclosure provides an image forming apparatus including an image forming unit, an intermediate transfer belt, a brush roller, a drive mechanism, a contact control mechanism, and an operation control unit. The image forming unit includes a photoconductor drum, and forms a toner image on an outer circumferential surface of the photoconductor drum. The intermediate transfer belt is disposed so as to oppose the photoconductor drum, so that when the intermediate transfer belt is in contact with the photoconductor drum the toner image is transferred from the photoconductor drum onto an outer surface of the intermediate transfer belt. The brush roller collects toner remaining on the outer surface of the intermediate transfer belt after the toner image is transferred from the intermediate transfer belt to a recording sheet. The drive mechanism drives the photoconductor drum, the intermediate transfer belt, and the brush roller. The contact control mechanism switches the photoconductor drum and the intermediate transfer belt to a non-contact phase from a contact phase. The operation control unit is configured to perform a cleaning mode including cleaning the brush roller while an image forming operation is not being performed, cause the contact control mechanism to set the photoconductor drum and the intermediate transfer belt to the non-contact phase in the cleaning mode, and cause the drive mechanism, while the photoconductor drum and the intermediate transfer belt are in the non-contact phase, to drive the brush roller to rotate at a rotation speed higher than a rotation speed of the brush roller in the image forming operation, and drive the intermediate transfer belt.

BRIEF DESCRIPTION OF THE DRAWINGS

FIG. 11 is a table showing experiment results regarding occurrence of toner stain, obtained through multitude of toner image forming on recording sheets;

FIGS. 15A and 15B are tables showing impacts of the cleaning operation of the fur brush on the life span of the photoconductor drum.

DETAILED DESCRIPTION

Hereafter, an image forming apparatus according to some embodiments of the disclosure will be described with reference to the drawings.

Embodiment 1

Figure 1:
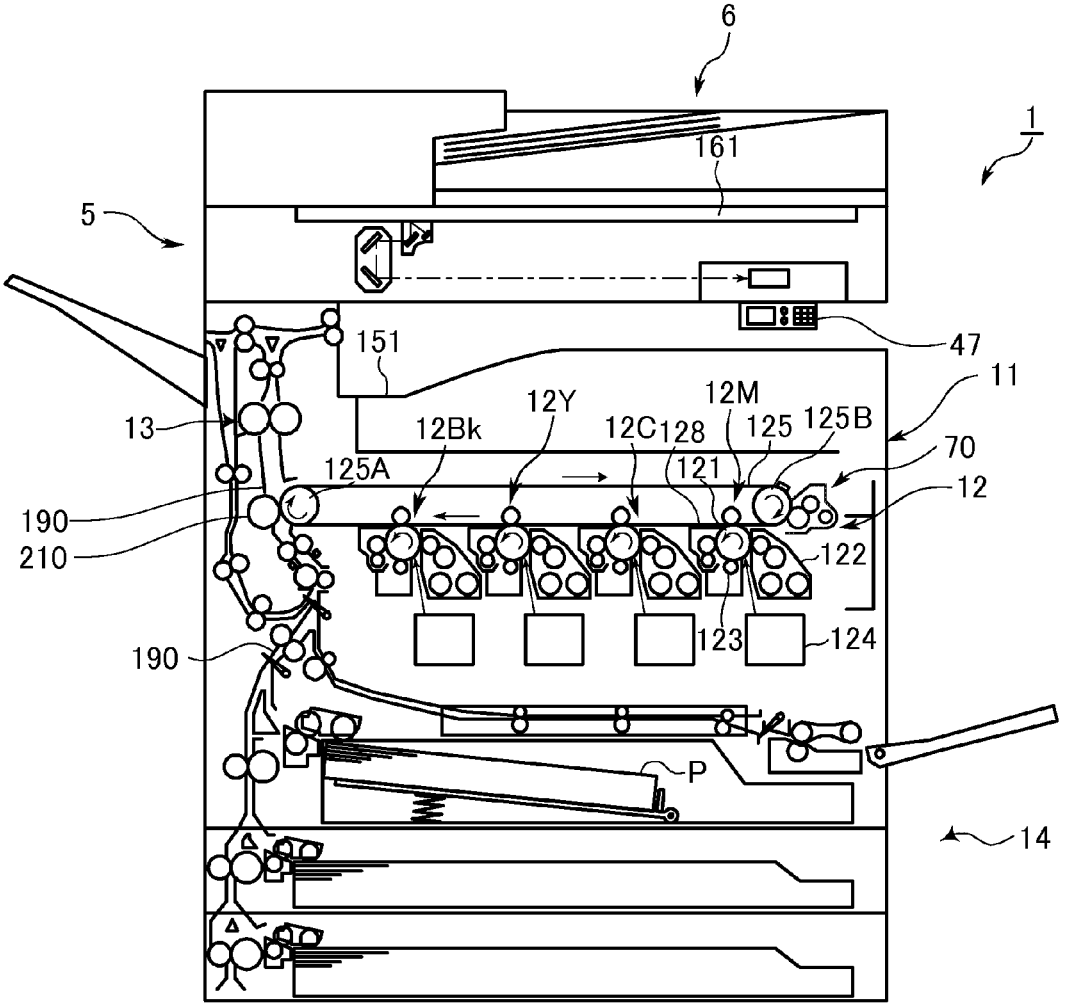
FIG. 1 is a cross-sectional view showing a configuration of an image forming apparatus according to an embodiment 1 of the disclosure.
Figure 2:
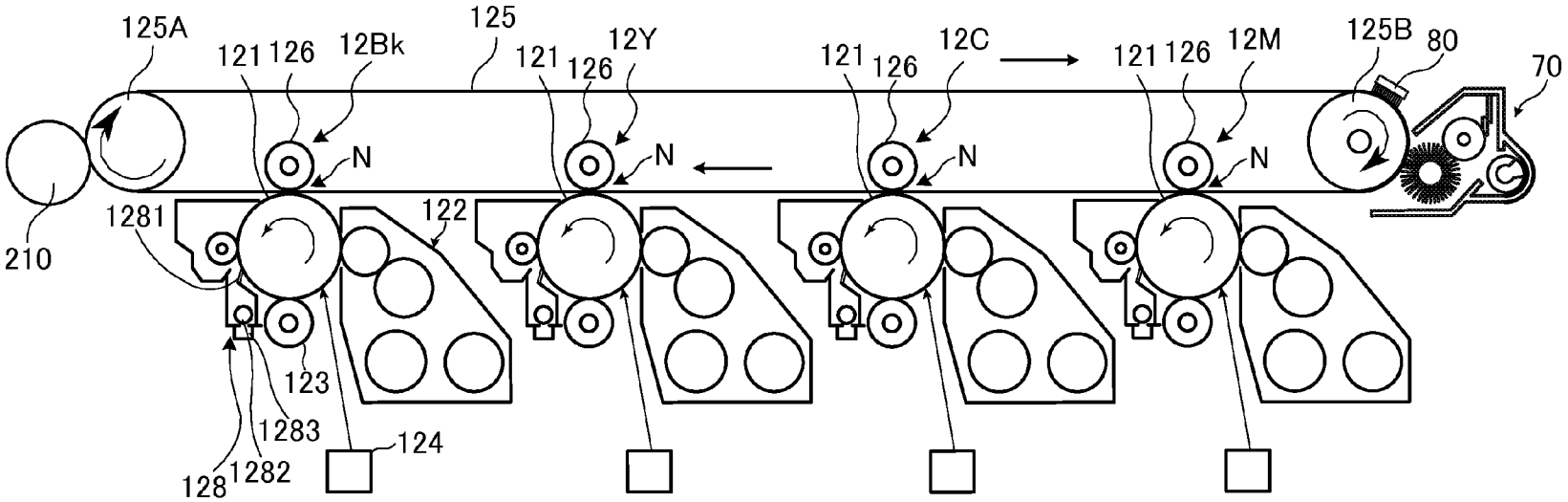
FIG. 2 is a cross-sectional view showing a configuration of an intermediate transfer belt and the periphery thereof, in the image forming apparatus according to the embodiment 1 of the disclosure.

FIG. 1 is a cross-sectional view showing a configuration of the image forming apparatus according to an embodiment 1 of the disclosure. FIG. 2 is a cross-sectional view showing a configuration of an intermediate transfer belt 125 and the periphery thereof, in the image forming apparatus according to the embodiment 1 of the disclosure.

The image forming apparatus 1 according to the embodiment 1 of the disclosure is a multifunction peripheral having a plurality of functions, such as copying, printing, scanning, and facsimile transmission. The image forming apparatus 1 includes an operation unit 47, an image forming unit 12, a fixing unit 13, a paper feed unit 14, a document feeder 6, and a document reading unit 5, which are mounted inside a main body 11.

The operation unit 47 receives instructions from the user, for operations and processes that the image forming apparatus 1 is configured to perform, such as image forming and document reading.

When the image forming apparatus 1 performs the document reading operation, the document reading unit 5 optically reads the image on a source document delivered from the document feeder 6 or placed on a platen glass 161, and generates image data. The image data generated by the document reading unit 5 is stored in a built-in HDD or a computer connected to a network.

When the image forming apparatus 1 performs the image forming operation, the image forming unit 12 forms a toner image on a recording sheet P serving as a recording medium and delivered from the paper feed unit 14, on the basis of the image data generated through the document reading operation, received from the computer connected to the network, or stored in the built-in HDD.

Image forming subunits 12M, 12C, 12Y, and 12Bk of the image forming unit 12 each include a photoconductor drum 121, a developing device 122, a non-illustrated toner cartridge storing toner, a charging device 123, an exposure device 124, and a primary transfer roller 126.

In a color printing operation, the image forming subunit 12M for magenta, the image forming subunit 12 for cyan, the image forming subunit 12Y for yellow, and the image forming subunit 12Bk for black in the image forming unit 12 each form a toner image based on the corresponding color component, on the photoconductor drum 121, through charging, exposing, and developing processes.

The primary transfer roller 126 is disposed so as to oppose the photoconductor drum 121 via the intermediate transfer belt 125. The primary transfer roller 126 is configured to be moved up or downward by a contact control mechanism 61 (see FIG. 5) under the control of an operation controller 101 (see FIG. 5), between a contact phase where the photoconductor drum 121 and the intermediate transfer belt 125 are in contact with each other and a non-contact phase where the intermediate transfer belt 125 are spaced from each other.

In the color printing operation, the contact control mechanism 61 causes the primary transfer rollers 126 of all the image forming subunits 12M, 12C, 12Y, and 12Bk to descend, thereby bringing all the photoconductor drums 121 of the image forming subunits 12M, 12C, 12Y, and 12Bk into contact with the intermediate transfer belt 125, as shown in FIG. 2. Accordingly, a nip position N is formed between each of the photoconductor drums 121 and the corresponding primary transfer roller 126. At such nip position N, the toner image of each color formed on the outer circumferential surface of the photoconductor drum 121 is transferred onto the outer surface of the intermediate transfer belt 125.

The intermediate transfer belt 125 is driven by a drive roller 125A to endlessly circulate between the drive roller 125A and a slave roller 125B. On the outer surface of the intermediate transfer belt 125, the toner images of different colors are superposed, so as to form a color toner image. A secondary transfer roller 210 transfers the color toner image formed on the surface of the intermediate transfer belt 125 onto the recording sheet P transported from the paper feed unit 14 along a transport route 190, via the intermediate transfer belt 125 at a nip position with the drive roller 125A. Thereafter, the fixing unit 13 fixes the toner image on the recording sheet P by heat-pressing. The recording sheet P on which the color image has been formed and fixed is discharged to an output tray 151.

Figure 3:
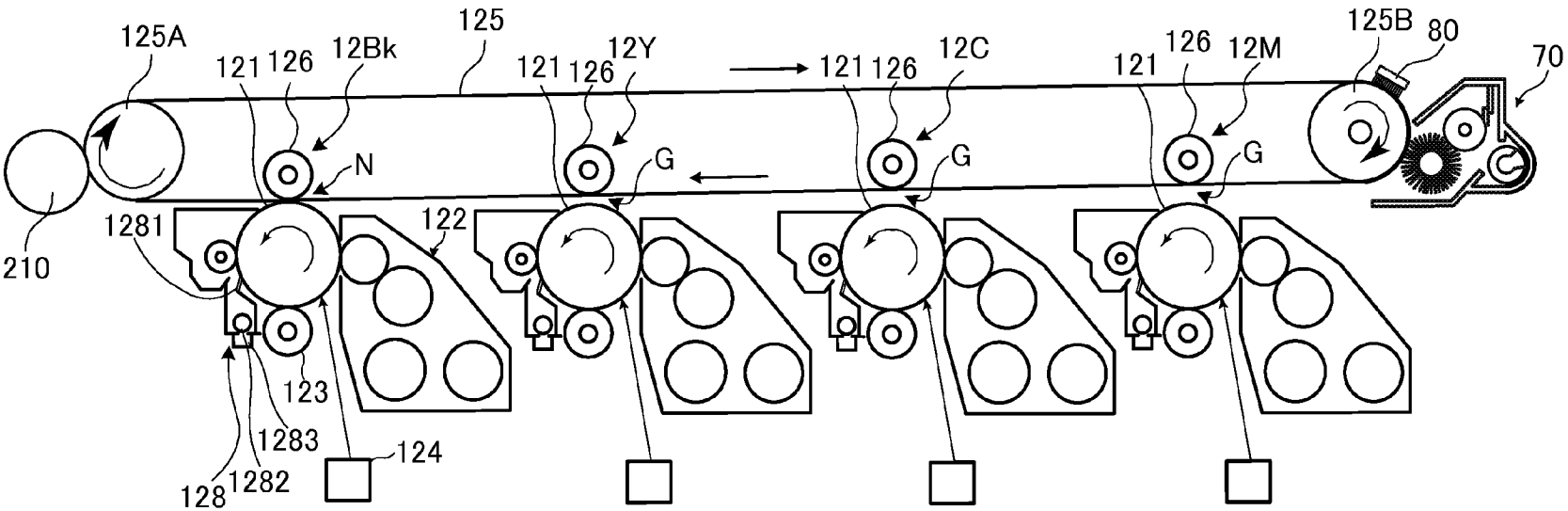
FIG. 3 is a cross-sectional view showing the intermediate transfer belt and the periphery thereof in the image forming apparatus, with three of photoconductor drums spaced from the intermediate transfer belt.

When a fur brush 71 of a cleaning device 70 is to be cleaned as will be subsequently described, the photoconductor drum 121 of at least one of the image forming subunits 12M, 12C, 12Y, and 12Bk is set to the non-contact phase, where the photoconductor drum 121 is spaced from the intermediate transfer belt 125. In the example shown in FIG. 3, the primary transfer rollers 126 of the image forming subunits 12M, 12C, and 12Y are moved upward by the contact control mechanism 61, so that the respective photoconductor drums 121 of the three image forming subunits 12M, 12C, and 12Y are set to the non-contact phase with respect to the intermediate transfer belt 125 (three-color non-contact phase). In addition, the contact control mechanism 61 has moved downward the primary transfer roller 126 of the image forming subunit 12Bk, so that the photoconductor drum 121 of the image forming subunit 12Bk is brought into contact with the intermediate transfer belt 125. Accordingly, a gap G is defined between each of the photoconductor drums 121 of the image forming subunits 12M, 12C, and 12Y and the corresponding primary transfer roller 126 of the image forming subunits 12M, 12C, and 12Y.

The image forming subunits 12M, 12C, 12Y, and 12Bk of the image forming unit 12 each further include a toner collection device 128 for collecting the toner remaining on the outer circumferential surface of the photoconductor drum 121. The toner collection device 128 includes a cleaning blade 1281, a toner reservoir 1282, and a toner conveying screw 1283. The cleaning blade 1281 is a flat plate-shaped member extending in an axial direction of the photoconductor drum 121. The cleaning blade 1281 is disposed such that the tip portion contacts the surface of the photoconductor drum 121, so as to remove the toner remaining on the surface of the photoconductor drum 121. The toner which has been removed drops into the toner reservoir 1282 to be deposited therein. The toner reservoir 1282 includes the toner conveying screw 1283. The toner conveying screw 1283 includes non-illustrated toner conveying vanes helically formed on the circumferential surface of the rotary shaft of the toner conveying screw 1283, so that the toner in the toner reservoir 1282 is collected to a predetermined position by the toner conveying vanes.

In addition, the cleaning device 70 is provided for the intermediate transfer belt 125, in the vicinity of the slave roller 125B. The cleaning device 70 serves to collect the toner remaining on the outer surface of the intermediate transfer belt 125 after the toner image formed on the outer surface thereof is transferred onto the recording sheet P.

Further, a charging brush (charging device) 80 is provided upstream of the cleaning device 70 in the running direction of the intermediate transfer belt 125. The charging brush 80 applies electric charge to the toner remaining on the outer surface of the intermediate transfer belt 125.

Figure 4:
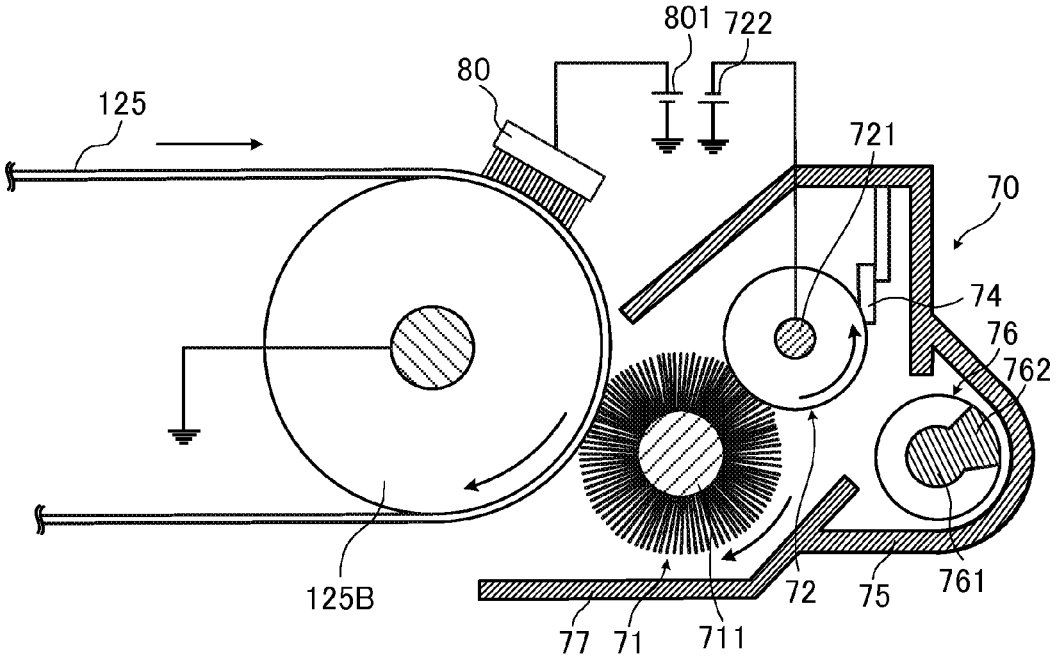
FIG. 4 is a cross-sectional view showing a configuration of a cleaning device and the periphery thereof, in the image forming apparatus according to the embodiment 1 of the disclosure.

FIG. 4 is a cross-sectional view showing a configuration of the cleaning device 70 and the periphery thereof, in the image forming apparatus according to the embodiment 1 of the disclosure.

The charging brush 80 is a fixed brush, disposed such that the brushing surface contacts the outer surface of the intermediate transfer belt 125. The charging brush 80 is connected to a charge bias applying unit (power source unit) 801. The charge bias applying unit 801 is controlled by the operation controller 101 (see FIG. 5) to be subsequently described, so as to apply a bias of the same polarity as the normal charge polarity to the charging brush 80, in the image forming operation. The slave roller 125B opposing the charging brush 80 is grounded. Here, the electric charge of the residual toner, remaining on the outer surface of the intermediate transfer belt 125 after the color image is transferred to the recording sheet P, is not uniform. For example, the residual toner may be charged in the reverse polarity (negative in this embodiment) to the normal charge polarity (positive in this embodiment), because of peeling discharge that takes place when the recording sheet P is removed from the intermediate transfer belt 125. The charging brush 80 receives the bias of the same polarity as the normal charge polarity from the charge bias applying unit 801, so as to apply a charge of the same polarity as the normal charge polarity to the residual toner. Accordingly, the electric charge of the residual toner can be made uniform, and the collection performance of the residual toner by the cleaning device 70 can be improved.

In addition, the operation controller 101 causes the charge bias applying unit 801 to apply the bias of the same polarity as the normal charge polarity to the charging brush 80, also in the cleaning operation of the fur brush 71 of the cleaning device 70, the details of which will be described hereunder.

The cleaning device 70 includes the fur brush (brush roller) 71, a collection roller 72, a cleaning blade 74, a toner reservoir 75, and a toner conveying screw 76.

The fur brush 71 is disposed so as to contact the outer surface of the intermediate transfer belt 125 at the position engaged with the slave roller 125B, so as to collect the toner remaining on the outer surface of the intermediate transfer belt 125 in the image forming operation. The fur brush 71 includes a rotary shaft 711 and a plurality of filaments raised on the circumferential surface of the rotary shaft 711. The rotary shaft 711 of the fur brush 71 is oriented in the axial direction of the slave roller 125B, and supported by a casing 77. The fur brush 71 is made to rotate about the rotary shaft 711 in the same direction as the slave roller 125B, by a drive mechanism 60 (see FIG. 5) to be subsequently described.

The fur brush 71 receives a bias of the reverse polarity to the normal charge polarity from a collection bias applying unit (power source unit) 722 to be subsequently described, through the collection roller 72. Accordingly, the toner remaining on the outer surface of the intermediate transfer belt 125 can be electrically adsorbed, thus to be collected.

The collection roller 72 contacts the surface of the fur brush 71, so as to collect therefrom the toner caught by the fur brush 71 in the image forming operation. The rotary shaft 721 of the collection roller 72 is oriented in the axial direction of the fur brush 71, and supported by the casing 77. The collection roller 72 rotates about the rotary shaft 721 in the opposite direction to the rotation of the fur brush 71.

The collection roller 72 is connected to the collection bias applying unit 722, to receive a bias of the reverse polarity to the normal charge polarity of the toner in the image forming operation. Accordingly, the potential of the collection roller 72 becomes lower than the potential of the fur brush 71, and therefore the toner caught by the fur brush 71 can be electrically adsorbed, thus to be collected.

The cleaning blade 74 is a flat plate-shaped member extending in the axial direction of the collection roller 72. The cleaning blade 74 is attached to the casing 77 such that the tip portion of the cleaning blade 74 contacts the surface of the collection roller 72. The cleaning blade 74 scrapes off the toner collected by the collection roller 72, from the surface thereof. The toner thus scraped off drops into the toner reservoir 75, to be deposited therein.

The toner reservoir 75 includes the toner conveying screw 76. The toner conveying screw 76 extends in the axial direction of the collection roller 72, and the rotary shaft 761 of the collection roller 72 is supported by the casing 77. The toner conveying screw 76 includes toner conveying vanes 762 helically formed on the circumferential surface of the rotary shaft 761, so that the toner in the toner reservoir 75 is collected by the toner conveying vanes 762 to a predetermined position in the direction of the rotary shaft 761. Thus, the residual toner on the outer surface of the intermediate transfer belt 125 can be collected.

Figure 5:
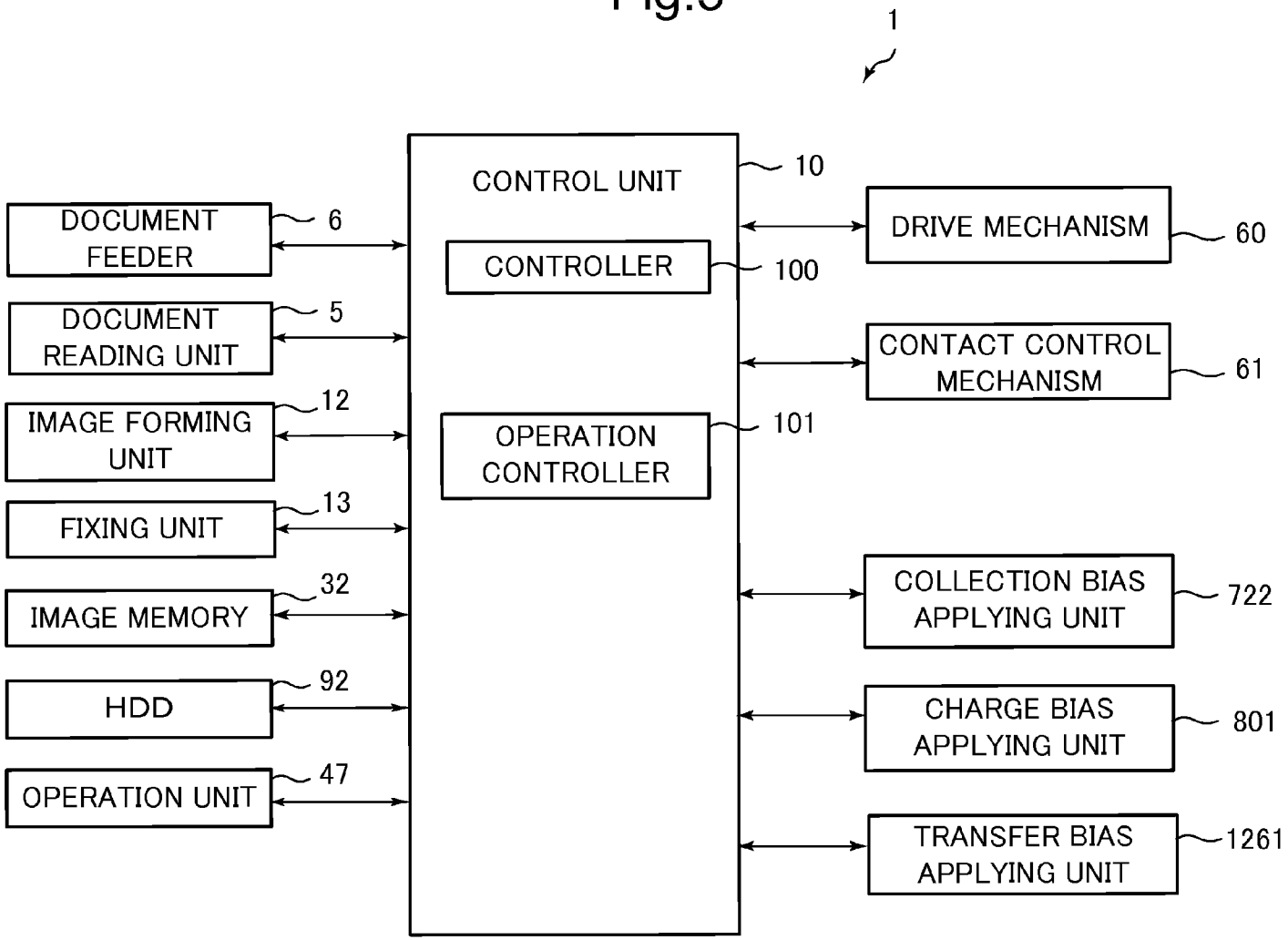
FIG. 5 is a functional block diagram showing an essential internal configuration of the image forming apparatus according to the embodiment 1 of the disclosure.

Hereunder, an internal configuration of the image forming apparatus 1 will be described. FIG. 5 is a functional block diagram showing the essential internal configuration of the image forming apparatus according to the embodiment 1. The description of the constituents already referred to will not be repeated.

An image memory 32 is a region for temporarily storing the image data to be formed into the image by the image forming unit 12.

A hard disk drive (HDD) 92 is a large-capacity storage device for storing image data, for example received from the computer connected to the image forming apparatus 1 via a network.

The drive mechanism 60 includes a motor, gears, a driver and so forth, and serves as drive source that provides driving force to the photoconductor drums 121, the intermediate transfer belt 125, the fur brush 71, and the collection roller 72.

A transfer bias applying unit 1261 includes a power supply unit connected to the primary transfer roller 126, and applies a predetermined bias to the primary transfer roller 126.

The image forming apparatus 1 further includes a control unit 10. The control unit 10 includes a central processing unit (CPU), a RAM, a ROM, and an exclusive hardware circuit. The CPU executes the program stored in the ROM or the HDD 92, to thereby cause the control unit 10 to act as controller 100 and operation controller 101.

The controller 100 serves to control the overall operation of the image forming apparatus 1. The controller 100 is connected to the document feeder 6, the document reading unit 5, the image forming unit 12, the fixing unit 13, the image memory 32, the HDD 92, the operation unit 47, the drive mechanism 60, the contact control mechanism 61, the collection bias applying unit 722, the charge bias applying unit 801, and the transfer bias applying unit 1261. The controller 100 controls the operation of the mentioned components connected thereto, and transmits and receives signals and data to and from those components.

The operation controller 101 is configured to perform, in addition to the image forming mode including controlling the operation of the image forming unit 12 so as to form the toner image on the recording sheet P, a cleaning mode including cleaning the fur brush 71 while the image forming is not being performed.

In the cleaning mode, the operation controller 101 causes the contact control mechanism 61 to set the photoconductor drum 121 and the intermediate transfer belt 125 to the non-contact phase. More specifically, the operation controller 101 causes the contact control mechanism 61 to set at least one of the photoconductor drums 121 of the image forming subunits 12M, 12C, 12Y, and 12Bk to the non-contact phase of being spaced from the intermediate transfer belt 125. The operation controller 101 then causes the drive mechanism 60, while the photoconductor drums 121 is spaced from the intermediate transfer belt 125, to drive the fur brush 71 to rotate at a rotation speed higher than the rotation speed thereof in the image forming operation, and to drive the intermediate transfer belt 125. Rotating the fur brush 71 at a rotation speed higher than in the image forming operation allows the toner stuck to the fur brush 71 during the image forming operation to be efficiently and effectively discharged onto the intermediate transfer belt 125. In addition, since the intermediate transfer belt 125 is driven with at least one of the photoconductor drums 121 spaced from the intermediate transfer belt 125, the life span of the photoconductor drum 121 can be prevented from being shortened owing to the cleaning operation of the fur brush 71.

Figure 6:
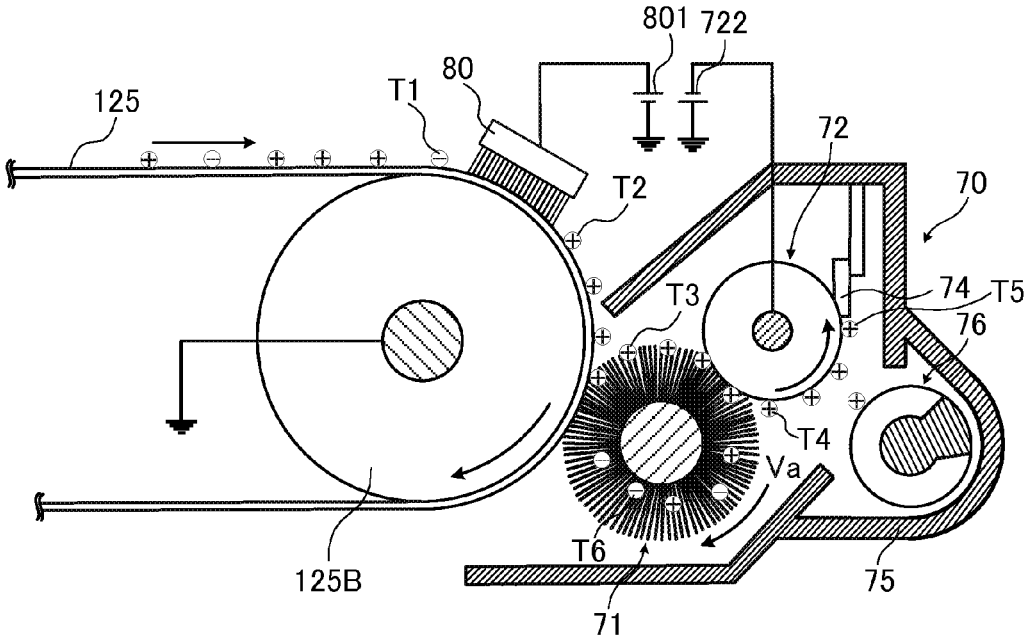
FIG. 6 is a cross-sectional view for explaining movement of toner collected by the cleaning device during the image forming process, in the image forming apparatus according to the embodiment 1 of the disclosure.

Hereunder, further details of the cleaning mode for cleaning the fur brush 71 will be described. Referring first to FIG. 6, the movement of the toner collected by the cleaning device 70 in the image forming operation will be described.

After the color image is transferred to the recording sheet P, the toner charged in the reverse polarity to the normal charge polarity is present on the outer surface of the intermediate transfer belt 125, as indicated by T1 in FIG. 6, in addition to the toner charged in the same polarity as the normal charge polarity. When the residual toner reaches the position opposing the charging brush 80, the toner is given the charge of the same polarity as the normal charge polarity by the charging brush 80, so that the electric charge becomes uniform (see T2 in FIG. 6).

The operation controller 101 causes the drive mechanism 60 to drive the fur brush 71 to rotate at a rotation speed Va. In addition, the fur brush 71 receives the bias of the reverse polarity to the normal charge polarity from the collection bias applying unit 722, through the collection roller 72. Accordingly, the residual toner that has reached the position opposing the fur brush 71 is electrically adsorbed thus to be collected, as indicated by T3 in FIG. 6.

The bias of the reverse polarity to the normal charge polarity is applied to the collection roller 72, and therefore the potential of the collection roller 72 is lower than that of the fur brush 71. Accordingly, as indicated by T4 in FIG. 6, the toner caught by the fur brush 71 is electrically adsorbed to the collection roller 72. The toner thus collected by the collection roller 72 is scraped off by the cleaning blade 74 as indicated by T5 in FIG. 6, and the toner scraped off drops into the toner reservoir 75, to be deposited therein.

As described above, the toner stuck to the fur brush 71 is collected by the collection roller 72, disposed in contact with the brushing surface of the fur brush 71 and having a potential lower than that of the fur brush 71, however the collection roller 72 may fail to sufficiently collect the toner, for example when an excessive amount of residual toner is present on the outer surface of the intermediate transfer belt 125 or when the residual toner is insufficiently charged. In such a case, the toner is accumulated in the fur brush 71 as indicated by T6 in FIG. 6. When the image forming operation is performed for an extended period of time, the amount of the toner accumulated in the fur brush 71 is increased, and therefore the toner may fall off from the fur brush 71 onto the outer surface of the intermediate transfer belt 125 during the image forming operation, thus to stain the image (toner spot).

Figure 7:
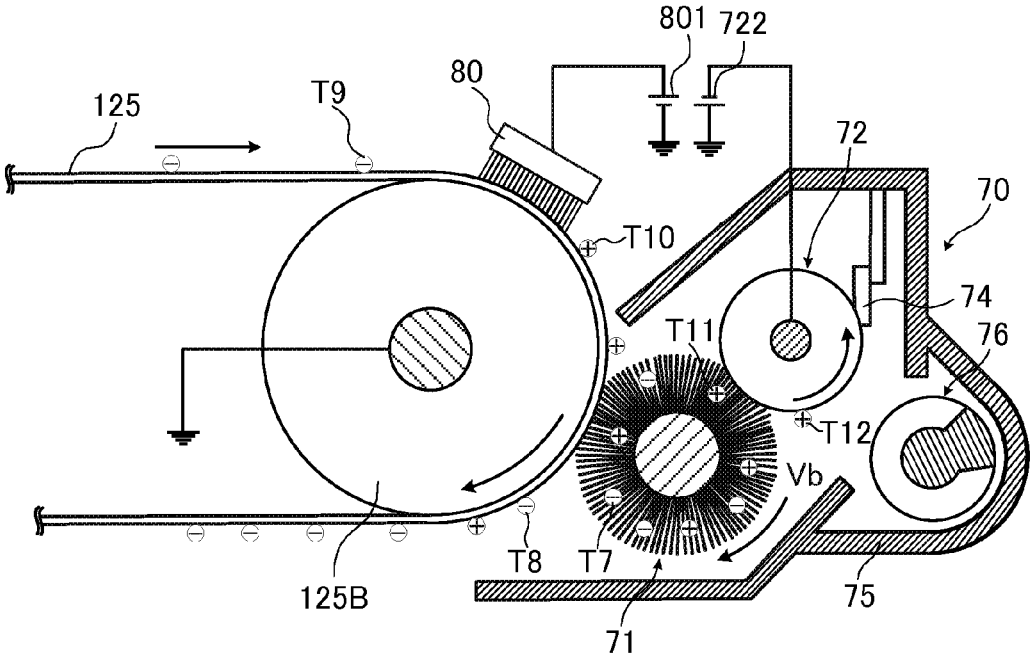
FIG. 7 is a cross-sectional view for explaining movement of the toner cleaned by a fur brush, in the image forming apparatus according to the embodiment 1 of the disclosure.

FIG. 7 is a cross-sectional view for explaining the movement of the toner cleaned by the fur brush 71. The operation controller 101 causes, in the cleaning operation of the fur brush 71, drive mechanism 60 to drive the fur brush 71 to rotate at a rotation speed Vb higher than the rotation speed Va in the image forming operation. Accordingly, the toner accumulated in the fur brush 71 moves toward the outer circumference of the fur brush 71 owing to centrifugal force, as indicated by T7 in FIG. 7. Therefore, as indicated by T8 in FIG. 7, the toner accumulated in the fur brush 71 is discharged out of the fur brush 71.

The toner discharged out of the fur brush 71 is a mixture of toner charged in the reverse polarity to the normal charge polarity and toner charged in the same polarity as the normal charge polarity but only weakly charged. Such toner is collected by the fur brush 71 again, or by the toner collection device 128 opposed to the photoconductor drum 121.

First, the recollection of the toner by the fur brush 71 will be described. The toner discharged from the fur brush 71 is transported by the intermediate transfer belt 125. In the example shown in FIG. 3, the respective photoconductor drums 121 of the image forming subunits 12M, 12C, and 12Y are spaced from the intermediate transfer belt 125, and therefore the surface of the photoconductor drums 121 of the image forming subunits 12M, 12C, and 12Y can be prevented from being degraded by friction during the cleaning of the fur brush 71, so that the life span of the photoconductor drum 121 can be prevented from being shortened.

The toner transported by the intermediate transfer belt 125 (see T9 in FIG. 7) receives, upon reaching the position opposing the charging brush 80, a charge of the same polarity as the normal charge polarity from the charging brush 80. Accordingly, the toner discharged from the fur brush 71 is charged in the same polarity as the normal charge polarity, as indicated by T10 in FIG. 7.

Thereafter, the toner is electrically adsorbed by the fur brush 71 thus to be collected thereby, as indicated by T11 in FIG. 7. As result of being charged by the charging brush 80 in the same polarity as the normal charge polarity, the toner discharged from the fur brush 71 is no longer the toner charged in the reverse polarity to the normal charge polarity or weakly charged in the same polarity as the normal charge polarity, and therefore such toner can be electrically adsorbed by the collection roller 72 thus to be collected thereby as indicated by T12 in FIG. 7, instead of being accumulated in the fur brush 71. Then the toner thus collected by the collection roller 72 is scraped off by the cleaning blade 74 and drops into the toner reservoir 75, to be deposited therein.

The collection of the toner by the toner collection device 128 will now be described. When the toner transported by the intermediate transfer belt 125 reaches the position opposing the photoconductor drum 121 that is in contact with the intermediate transfer belt 125 (in FIG. 3, photoconductor drum 121 of the image forming subunit 12Bk), the toner is transferred onto the outer circumferential surface of the photoconductor drum 121, by the primary transfer roller 126. Here, the operation controller 101 causes the transfer bias applying unit 1261 to apply a bias of the same polarity as the polarity of the toner discharged from the fur brush 71, to the primary transfer roller 126. Since the majority of the toner discharged from the fur brush 71 in the cleaning mode is charged in the reverse polarity to the normal charge polarity (see FIG. 7), the operation controller 101 causes the transfer bias applying unit 1261 to apply a bias of the reverse polarity to the normal charge polarity to the primary transfer roller 126.

Since the bias of the same polarity as the charge of the toner discharged from the fur brush 71 is applied to the primary transfer roller 126, an electric reactive force is exerted on the toner discharged from the fur brush 71, and therefore the toner migrates to the outer circumferential surface of the photoconductor drum 121 of the image forming subunit 12M. A part of the toner discharged from the fur brush 71 that has not migrated to the outer circumferential surface of the photoconductor drum 121 of the image forming subunit 12M is transported by the intermediate transfer belt 125 and collected by the cleaning device 70. The remaining part of the toner that has migrated to the outer circumferential surface of the photoconductor drum 121 is conveyed so as to follow up the rotation of the photoconductor drum 121, and collected by the toner collection device 128 upon reaching the position opposing the toner collection device 128.

Although the operation controller 101 causes the photoconductor drum 121, the primary transfer roller 126, and the toner collection device 128 of the image forming subunits 12M to operate in the cleaning mode, the operation controller 101 does not drive the remaining components, which are the developing device 122, the charging device 123, and the exposure device 124. This is because the charging, the exposing, and the developing processes are not involved in the cleaning mode.

Figure 8:
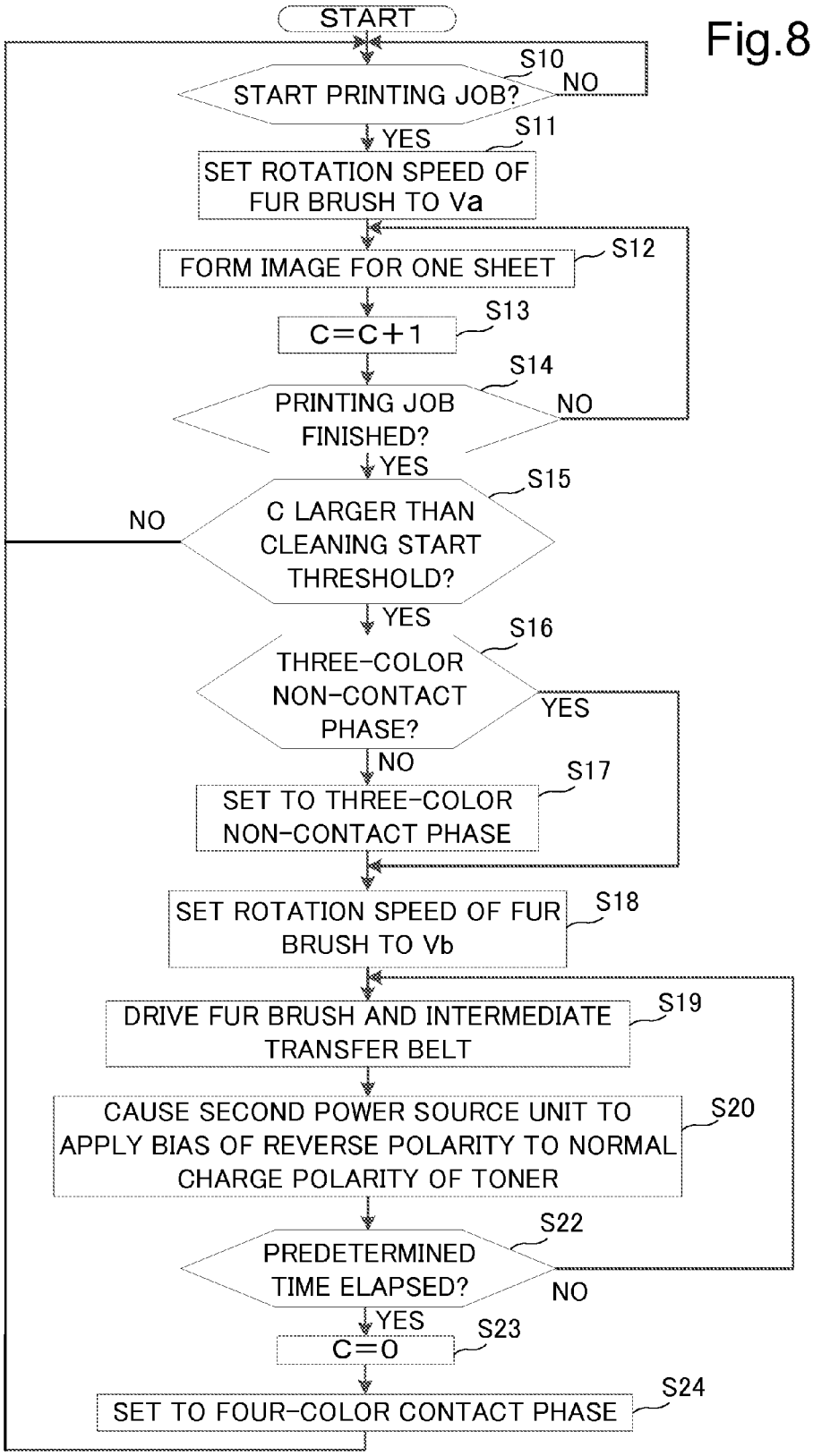
FIG. 8 is a flowchart showing an operation process performed by the image forming apparatus according to the embodiment 1 of the disclosure.

Hereunder, an operation of the image forming apparatus 1 configured as above will be described. FIG. 8 is a flowchart showing the operation process performed by the image forming apparatus 1 according to the embodiment 1.

As shown in FIG. 8, first the controller 100 decides whether an instruction to start a printing job has been received (step S10).

In the case where the instruction to start the printing job has been received (YES at step S10), the operation controller 101 sets the rotation speed of the fur brush 71 to Va, and causes the drive mechanism 60 to drive the fur brush 71 to rotate at the rotation speed Va (step S11).

Then the operation controller 101 controls the operation of the image forming unit 12 so as to form a toner image on the recording sheet P (step S12 to step S14). Upon causing the image forming unit 12 to form an image corresponding to one recording sheet P (step S12), the operation controller 101 increases a count value C by 1 (step S13). The controller 100 then decides whether the printing job has been finished (step S14), and in the case where the printing job has not been finished (NO at step S14), the controller 100 returns to the process of step S12.

In the case where the printing job has been finished (YES at step S14), the operation controller 101 compares the count value C with a predetermined cleaning mode starting threshold (for example, 1000) (step S15).

When the count value C is smaller than the cleaning mode starting threshold (NO at step S15), the operation controller 101 returns to the process of step S10 without entering the cleaning mode.

When the count value C is equal to or larger than the cleaning mode starting threshold (YES at step S15), the operation controller 101 enters the cleaning mode (step S16 to S22). First, the operation controller 101 decides whether the photoconductor drums 121 of the image forming unit 12 are in the three-color non-contact phase with respect to the intermediate transfer belt 125 (step S16), and when the photoconductor drums 121 are not in the three-color non-contact phase (NO at step S16), the operation controller 101 causes the contact control mechanism 61 to set the photoconductor drums 121 to the three-color non-contact phase with respect to the intermediate transfer belt 125 (step S17). Then the operation controller 101 sets the rotation speed of the fur brush 71 to Vb (higher than Va) (step S18).

The operation controller 101 then causes the drive mechanism 60 to drive the fur brush 71 to rotate at the rotation speed set at step S18 (step S19). The operation controller 101 also causes the drive mechanism 60 to drive the intermediate transfer belt 125 (step S19). At this point, the operation controller 101 causes the drive mechanism 60 to drive the intermediate transfer belt 125 at a speed equivalent to the circumferential speed set in the image forming operation. Driving thus the intermediate transfer belt 125 at a high circumferential speed prevents the surface of the photoconductor drum 121 in contact with the intermediate transfer belt 125 from being degraded by friction.

Here, the drive mechanism 60 may be configured so as to drive the intermediate transfer belt 125 and the fur brush 71 in linkage with each other, from the viewpoint of reduction of the manufacturing cost. In this case, the intermediate transfer belt 125 is driven by the drive mechanism 60 at a higher circumferential speed than in the image forming operation, in linkage with the rotation speed of the fur brush 71. Therefore, with such configuration to drive the intermediate transfer belt 125 and the fur brush 71 in linkage with each other, the life span of the photoconductor drum 121 can be more effectively prevented from being shortened by the cleaning operation of the fur brush 71, by locating the photoconductor drum 121 away from the intermediate transfer belt 125.

In the process of step S19 referred to above, the operation controller 101 further causes the charge bias applying unit 801 to apply a bias of the same polarity as the normal charge polarity to the charging brush 80, so as to charge the toner discharged from the fur brush 71 in the same polarity as the normal charge polarity.

At the same time as performing the process of step S19, the operation controller 101 causes the transfer bias applying unit 1261 to apply a bias of the reverse polarity to the normal charge polarity to the primary transfer roller 126 (step S20).

At step S20, the operation controller 101 also drives the toner conveying screw 76 to rotate, so as to concentrate the toner collected by the collection roller 72 at a predetermined position in the toner reservoir 75.

The operation controller 101 performs the process of step S19 and step S20 until a predetermined time (for example, 40 seconds) elapses (step S22). When the predetermined time has elapsed, the operation controller 101 finishes the cleaning mode and resets the count value C (step S23). Then the operation controller 101 causes the contact control mechanism 61 to set all the photoconductor drums 121 to the contact phase with the intermediate transfer belt 125 (four-color contact phase) (step S24), and returns to the process of step S10.

[Consideration]

Figure 9:
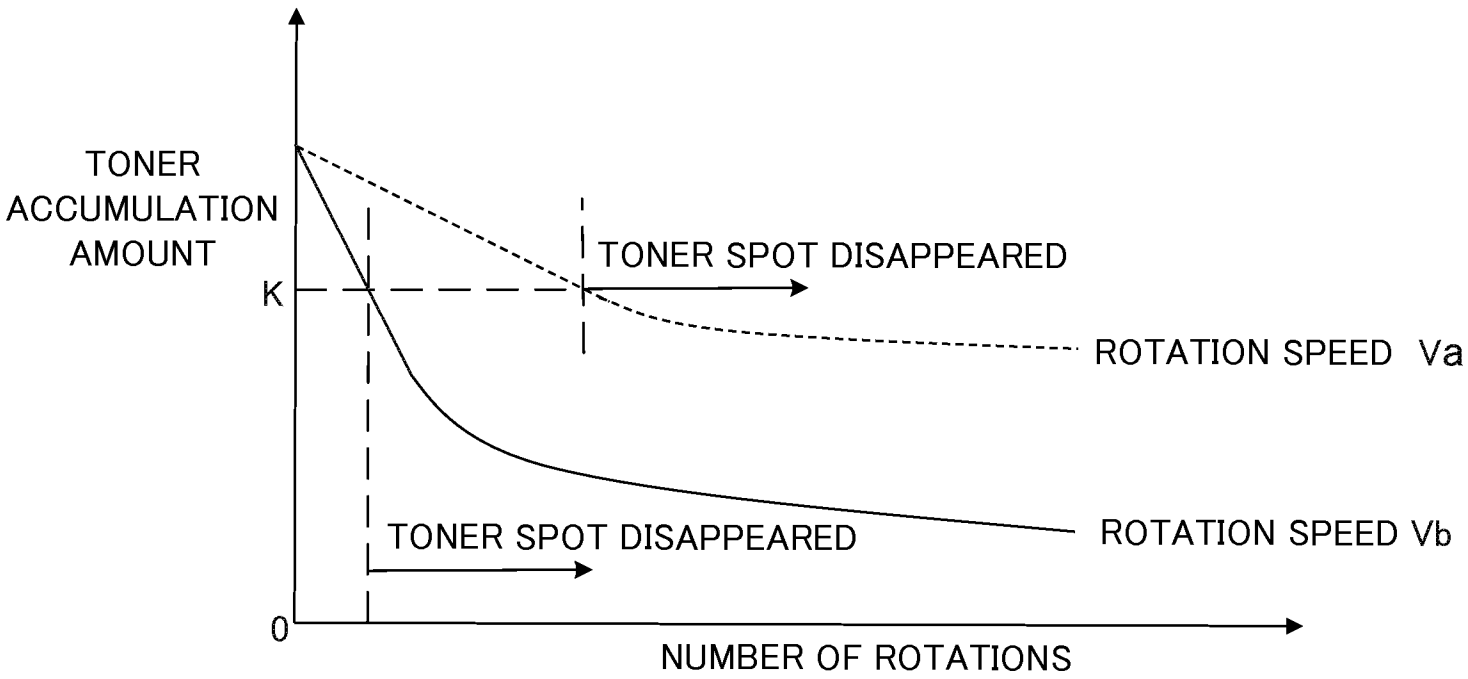
FIG. 9 is a graph showing a relation between the rotation speed of the fur brush in a cleaning mode and the amount of toner deposited on the fur brush.

FIG. 9 is a graph showing a relation between the rotation speed of the fur brush 71 in the cleaning mode and the amount of toner accumulated in the fur brush 71. In FIG. 9, the vertical axis represents the amount of the toner accumulated in the fur brush 71, and the horizontal axis represents the rotation speed of the fur brush 71. A code K on the vertical axis designates a threshold of the toner amount where the fur brush 71 may create a toner spot. The threshold is determined depending on the type of material of the fur brush 71 and the viscosity of the toner.

As is apparent from FIG. 9, when the fur brush 71 is rotated at the higher speed Vb the amount of the toner accumulated in the fur brush 71 is reduced more rapidly than when the fur brush 71 is rotated at the lower speed Va. Accordingly, the toner spot can be suppressed with a fewer number of rotations of the fur brush 71, and therefore the fur brush 71 can be efficiently cleaned, so that the time required for the cleaning mode can be shortened.

Figure 10:
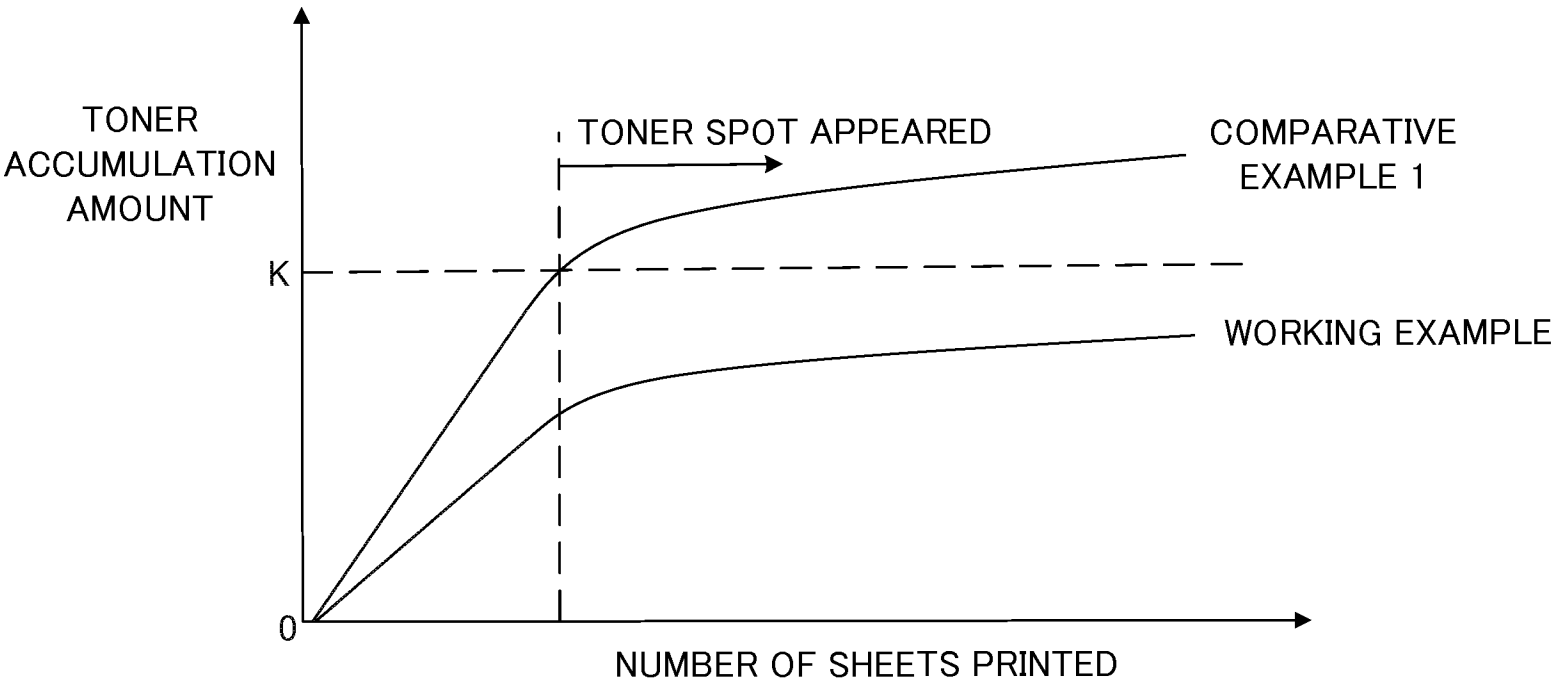
FIG. 10 is a graph showing a relation between the number of recording sheets subjected to the image forming operation and the amount of toner accumulated in the fur brush.

FIG. 10 is a graph showing a relation between the number of recording sheets subjected to the image forming operation and the amount of the toner accumulated in the fur brush 71. In FIG. 10, a line denoted as Working Example represents the transition of the amount of accumulated toner in the image forming apparatus 1 according to the embodiment 1, and a line denoted as Comparative Example 1 represents the transition of the amount of accumulated toner in an image forming apparatus not designed to perform the cleaning mode. In FIG. 10, in addition, the vertical axis represents the amount of the toner accumulated in the fur brush 71, and the horizontal axis represents the number of recording sheets subjected to the image forming operation.

As is apparent from FIG. 10, with the image forming apparatus according to the comparative example 1 not designed to perform the cleaning mode, the amount of the toner accumulated in the fur brush 71 increases at a higher rate with the increase of the number of subjected to the image forming operation until a toner spot appears, however with the image forming apparatus 1 according to the embodiment 1 configured to perform the cleaning mode, the amount of the toner accumulated in the fur brush 71 increases at a lower rate, and does not reach the point where the toner spot appears.

[Experiment]

The disclosers have performed, in order to confirm the effect of the cleaning mode set in the image forming apparatus 1 according to the embodiment 1, toner image forming operations on recording sheets P a plurality of times at different printing rates, with two types of image forming apparatuses, one being the image forming apparatus 1 according to the embodiment 1, and the other being an image forming apparatus according to a comparative example 1, and checked whether a toner spot appears. The image forming apparatus according to the comparative example 1 is not configured to perform the cleaning mode. The experiment results are shown in FIG. 11. In FIG. 11, circles indicate that no toner spots appeared before the image forming operation was performed on 3000 recording sheets. Triangles indicate that one toner spot appeared while the image forming operation was performed between 100 and 3000 recording sheets. Crosses indicate that one or more toner spots appeared before the image forming operation was performed on 100 recording sheets.

As is apparent from FIG. 11, with the image forming apparatus according to the comparative example 1 without the cleaning mode, the toner spots started to appear when the number of recording sheets printed exceeded 200K (two hundred thousand) at a printing rate of 20%, while with the image forming apparatus 1 according to the embodiment 1 the toner spots started to appear when the number of recording sheets printed exceeded 600K (six hundred thousand). Accordingly, it is understood that the image forming apparatus 1 configured to perform the cleaning mode is less likely to allow the toner to fall off from the brush roller onto the outer surface of the intermediate transfer belt so as to stain the image during the image forming operation, compared with the image forming apparatus according to the comparative example 1 without the cleaning mode.

In conventional image forming apparatuses, the toner caught by the brush roller (fur brush) is collected by the collection roller or the like disposed in contact with the outer circumferential surface of the brush roller, however when a large amount of residual toner remains on the outer surface of the intermediate transfer belt, or when the residual toner is only weakly charged, the collection roller may fail to sufficiently collect the toner and the toner may accumulate in the brush roller. When an excessive amount of toner is accumulated in the brush roller, the toner may fall off from the brush roller onto the outer surface of the intermediate transfer belt during the image forming operation, so that the image quality is degraded.

To prevent the toner from falling off from the brush roller onto the outer surface of the intermediate transfer belt, the brush roller may be cleaned while the image forming operation is not being performed. However, cleaning the brush roller may incur an impact on other devices such as the photoconductor drum, and the life span of such devices may be degraded.

From such viewpoint, the image forming apparatus 1 according to the embodiment 1 of the disclosure is configured to rotate the fur brush 71 at a rotation speed higher than the rotation speed thereof in the image forming operation, and therefore the toner accumulated in the fur brush 71 during the image forming operation can be efficiently and effectively discharged onto the intermediate transfer belt 125. In addition, the intermediate transfer belt 125 is driven with at least one of the photoconductor drums 121 set to the non-contact phase with respect to the intermediate transfer belt 125, and therefore the life span of the photoconductor drum 121 can be prevented from being shortened owing to the cleaning operation of the fur brush 71. Thus, the fur brush 71 can be efficiently and effectively cleaned with a minimized impact on the life span of the photoconductor drum 121, and the toner can be prevented from falling off from the brush roller onto the outer surface of the intermediate transfer belt during the image forming operation, and staining the image.

Embodiment 2

In the image forming apparatus 1 according to an embodiment 2 of the disclosure, all of the plurality of photoconductor drums 121 are set to the non-contact phase with respect to the intermediate transfer belt 125 in the cleaning operation of the fur brush 71, and the fur brush 71 is made to rotate, under the mentioned condition, at a rotation speed higher than the rotation speed thereof in the image forming operation.

Figure 12:
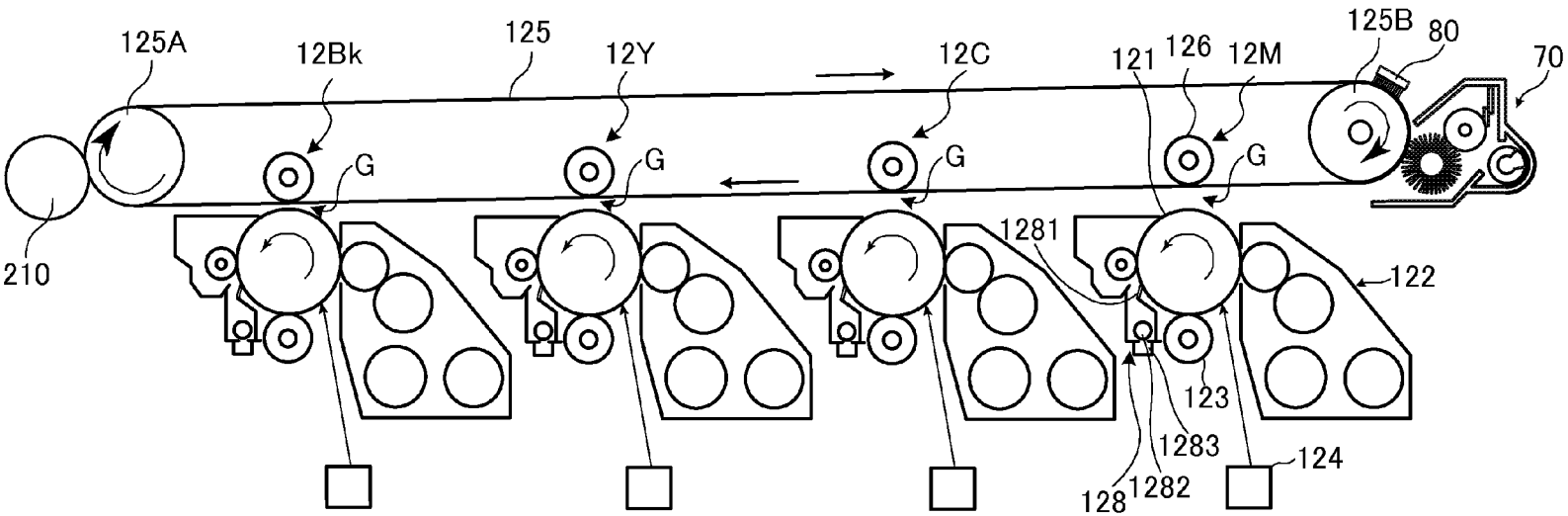
FIG. 12 is a cross-sectional view showing the intermediate transfer belt and the periphery thereof in the image forming apparatus, with four of photoconductor drums spaced from the intermediate transfer belt.

As shown in FIG. 12, in the image forming apparatus 1 according to the embodiment 2, the contact control mechanism 61 causes the respective primary transfer rollers 126 of the image forming subunits 12M, 12C, 12Y, and 12Bk to ascend, so as to set the photoconductor drums 121 of all the image forming subunits 12M, 12C, 12Y, and 12Bk to the non-contact phase with respect to the intermediate transfer belt 125 (four-color non-contact phase). Accordingly, the toner discharged from the fur brush 71 is unable to be collected by the toner collection device 128 opposed to the photoconductor drum 121. Therefore, although the collection performance of the toner discharged from the fur brush 71 is somewhat lower than the image forming apparatus 1 according to the embodiment 1, the cleaning operation of the fur brush 71 is performed with none of the photoconductor drums 121 disposed in contact with the intermediate transfer belt 125, and therefore none of the photoconductor drums 121 have the surface subjected to friction during the cleaning operation of the fur brush 71, and thus the degradation of the life span of the photoconductor drums 121 can be completely prevented.

Figure 13:
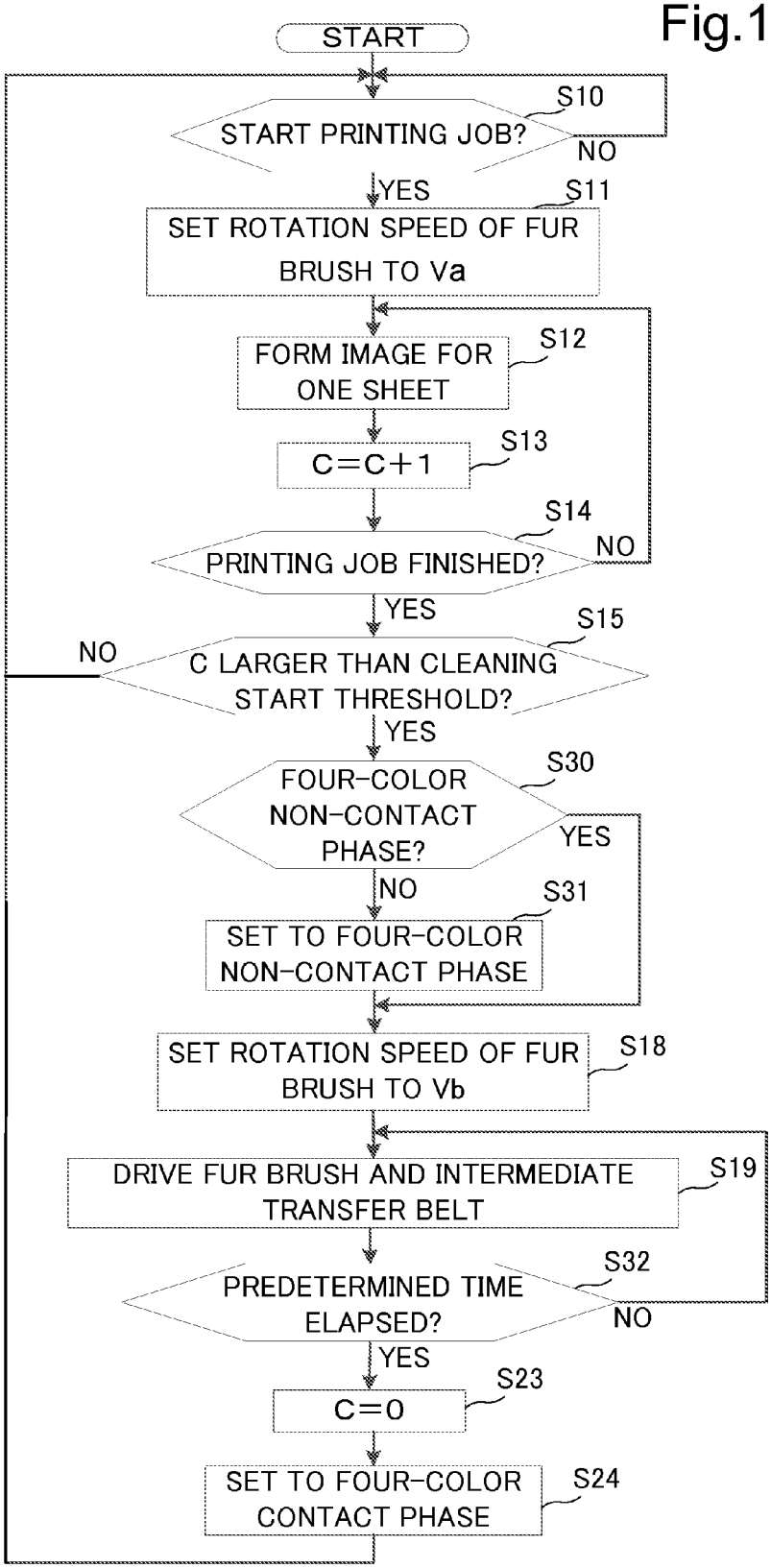
FIG. 13 is a flowchart showing an operation process performed by an image forming apparatus according to an embodiment 2 of the disclosure.

FIG. 13 is a flowchart showing an operation process performed by the image forming apparatus 1 according to the embodiment 2. The same steps as those of FIG. 8 will be given the same numeral, and the description thereof will not be repeated.

In the cleaning mode, the operation controller 101 decides whether the photoconductor drums 121 of the image forming unit 12 are in the four-color non-contact phase with respect to the intermediate transfer belt 125 (step S30), and when the photoconductor drums 121 are not in the four-color non-contact phase (NO at step S30), the operation controller 101 causes the contact control mechanism 61 to set the photoconductor drums 121 to the four-color non-contact phase with respect to the intermediate transfer belt 125 (step S31). Then the operation controller 101 sets the rotation speed of the fur brush 71 to Vb (higher than Va) (step S18), and causes the drive mechanism 60 to drive the fur brush 71 to rotate at the rotation speed set at step S18 (step S19). The operation controller 101 also causes the drive mechanism 60 to drive the intermediate transfer belt 125 (step S19).

In the case where the drive mechanism 60 is configured to drive the intermediate transfer belt 125 and the fur brush 71 in linkage with each other also, since the intermediate transfer belt 125 is driven with none of the photoconductor drums 121 disposed in contact with the intermediate transfer belt 125, the life span of the photoconductor drums 121 can be prevented from being shortened owing to the friction with the intermediate transfer belt 125 driven at a high speed.

The operation controller 101 performs the operation of step S19 until a predetermined time (for example, 40 seconds) elapses (step S32). When the predetermined time has elapsed, the operation controller 101 finishes the cleaning mode and resets the count value C (step S23). Then the operation controller 101 causes the contact control mechanism 61 to set all the photoconductor drums 121 to the contact phase with the intermediate transfer belt 125 (four-color contact phase) (step S24), and returns to the process of step S10.

Embodiment 3

In the image forming apparatus 1 according to an embodiment 3 of the disclosure, all of the plurality of photoconductor drums 121 are set to the non-contact phase with respect to the intermediate transfer belt 125 in the cleaning operation of the fur brush 71, and the fur brush 71 is made to rotate, under the mentioned condition, at a rotation speed higher than the rotation speed thereof in the image forming operation, as in the image forming apparatus 1 according to the embodiment 2. In addition, the image forming apparatus 1 according to the embodiment 3 brings at least one of the photoconductor drums 121 into contact with the intermediate transfer belt 125 after driving the fur brush 71 to rotate, and drives the intermediate transfer belt 125 under the mentioned condition and applies a bias of the reverse polarity to the normal charge polarity to the primary transfer roller 126.

In the case where the drive mechanism 60 is configured to drive the intermediate transfer belt 125 and the fur brush 71 in linkage with each other, the intermediate transfer belt 125 is driven at a high speed in linkage with the high-speed rotation of the fur brush 71. In this relation, in the image forming apparatus 1 according to the embodiment 3 none of the photoconductor drums 121 are in contact with the intermediate transfer belt 125 while the intermediate transfer belt 125 is driven at a high speed in linkage with the high-speed rotation of the fur brush 71, and when the high-speed rotation of the fur brush 71 is finished at least one of the photoconductor drums 121 is brought into contact with the intermediate transfer belt 125 so as to allow the toner collection device 128 opposed to the photoconductor drum 121 to collect the toner. Such an arrangement prevents the life span of the photoconductor drums 121 from being shortened owing to the friction with the intermediate transfer belt 125 driven at a high speed, while securing sufficient collection performance of the toner discharged from the fur brush 71.

Figure 14:
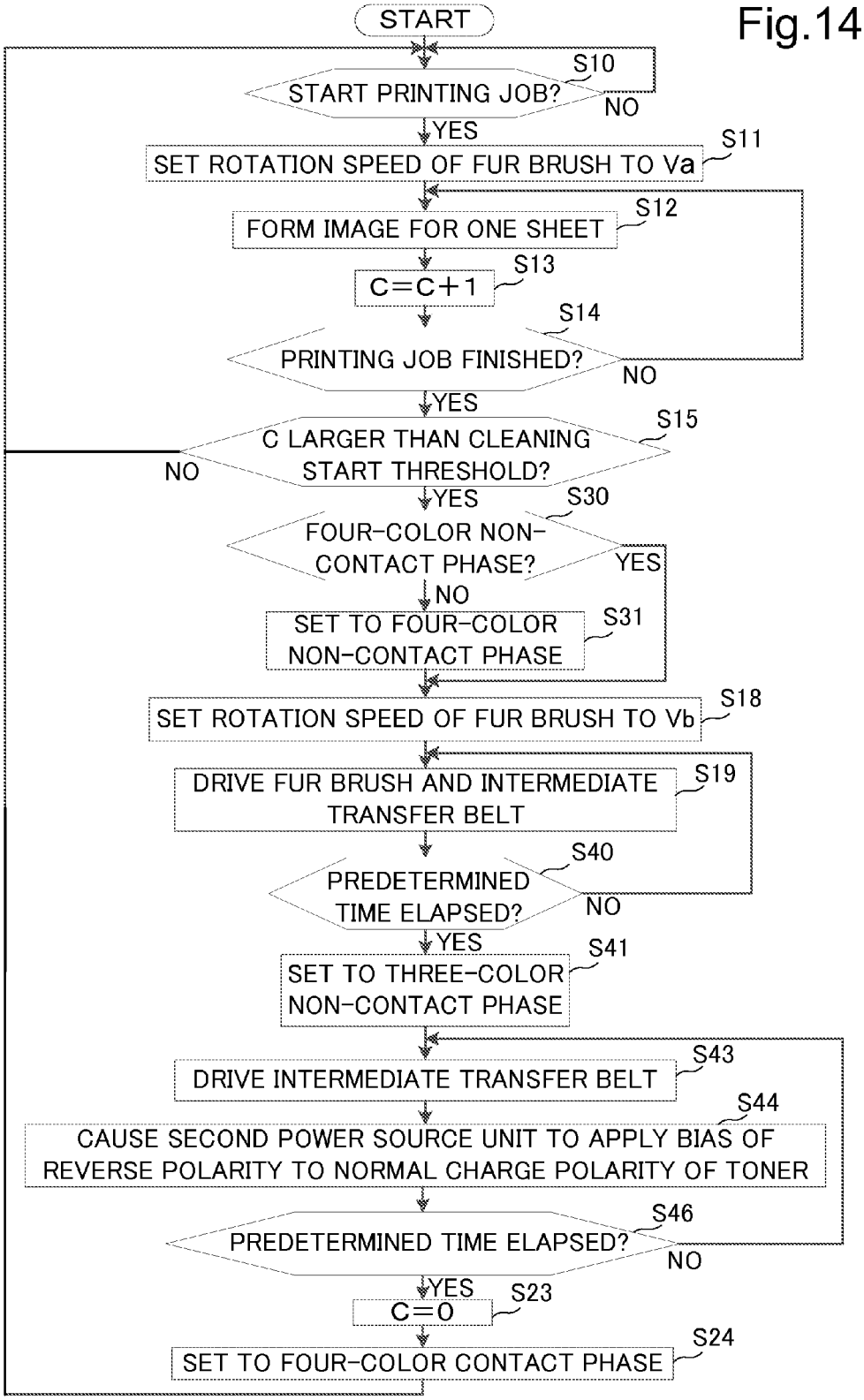
FIG. 14 is a flowchart showing an operation process performed by an image forming apparatus according to an embodiment 3 of the disclosure.

FIG. 14 is a flowchart showing an operation process performed by the image forming apparatus 1 according to the embodiment 3. The same steps as those of FIG. 8 and FIG. 13 will be given the same numeral, and the description thereof will not be repeated.

After performing the operation of step S19 for a predetermined time (for example, 20 seconds) (YES at step S40), the operation controller 101 causes the contact control mechanism 61 to set the photoconductor drums 121 to the three-color non-contact phase with respect to the intermediate transfer belt 125 (step S41). At step S41, the operation controller 101 may cause the contact control mechanism 61 to bring at least one of the photoconductor drums 121 of the image forming subunits 12M, 12C, 12Y, and 12Bk into contact with the intermediate transfer belt 125.

After step S41, the operation controller 101 causes the drive mechanism 60 to drive the intermediate transfer belt 125 (step S43). In the case where the drive mechanism 60 is configured to drive the intermediate transfer belt 125 and the fur brush 71 in linkage with each other, at step S19 the intermediate transfer belt 125 is driven by the drive mechanism 60 at a circumferential speed (first circumferential speed) higher than the circumferential speed thereof in the image forming operation in linkage with the rotation of the fur brush 71. At step S43, in contrast, the operation controller 101 causes the drive mechanism 60 to drive the intermediate transfer belt 125 at a second circumferential speed lower than the first circumferential speed. Such an arrangement prevents the life span of the photoconductor drums 121 from being shortened owing to the friction with the intermediate transfer belt 125 driven at a high speed.

At the same time as performing the operation of step S43, the operation controller 101 causes the transfer bias applying unit 1261 to apply a bias of the reverse polarity to the normal charge polarity to the primary transfer roller 126 (step S44).

The operation controller 101 performs the operation of step S43 and step S44 until a predetermined time (for example, 20 seconds) elapses (step S46). When the predetermined time has elapsed, the operation controller 101 finishes the cleaning mode and resets the count value C (step S23). Then the operation controller 101 causes the contact control mechanism 61 to set all the photoconductor drums 121 to the contact phase with the intermediate transfer belt 125 (four-color contact phase) (step S24), and returns to the process of step S10.

[Experiment]

FIGS. 15A and 15B are tables showing impacts of the cleaning operation of the fur brush 71 on the life span of the photoconductor drum 121, under the conditions of the embodiment 1, the embodiment 3, and a comparative example 2. The comparative example 2 represents the case where the cleaning operation according to the embodiment 1 has been performed with all the photoconductor drums (C drum, M drum, Y drum, and Bk drum) disposed in contact with the intermediate transfer belt 125, instead of away from the intermediate transfer belt 125.

Referring to FIGS. 15A and 15B, parameters such as the whole-life number of recording sheets representing the number of recording sheets P that can be printed by the photoconductor drum 121 during its life, the printing distance per recording sheet P, and the distance between a recording sheet P and another are the same under all the conditions, and the whole-life distance, calculated on the basis of each of the parameters and representing the distance that the photoconductor drum 121 can cover during its life is also the same under all the conditions, namely 162000000 mm.

The cleaning operation of the fur brush 71 is performed each time 1000 recording sheets have been printed, under the conditions of the embodiment 1, the embodiment 3, and the comparative example 2. Accordingly, the cleaning operation of the fur brush 71 is performed 600 times, obtained by dividing the whole-life number of recording sheets of 600000 by 1000, before the life of the photoconductor drum 121 comes to an end. All the photoconductor drums 121 according to the comparative example 2 runs for 40 seconds in each cleaning operation of the fur brush 71, and therefore the photoconductor drum 121 runs a distance of 9432000 mm in contact with the intermediate transfer belt 125, which is obtained by multiplying 40×600 by the linear speed. Therefore, the impact rate of the cleaning operation of the fur brush 71 on the life span of all the photoconductor drums 121 according to the comparative example 2 is calculated as 5.8% (9432000/162000000×100).

In contrast, in the case of the photoconductor drums 121 spaced from the intermediate transfer belt 125 (C drum, M drum, and Y drum) according to the embodiment 1, the distance covered in contact with the intermediate transfer belt 125 is 0 mm. Therefore, the impact rate of the cleaning operation of the fur brush 71 on the life span of the C drum, the M drum, and the Y drum according to the embodiment 1 is 0%.

Likewise, in the case of the photoconductor drum 121 disposed in contact with the intermediate transfer belt 125 (Bk drum) according to the embodiment 1, the distance covered in contact with the intermediate transfer belt 125 is 9432000 mm. Therefore, the impact rate of the cleaning operation of the fur brush 71 on the life span of the Bk drum according to the embodiment 1 is calculated as 5.8%.

In addition, the distance covered by all the photoconductor drums 121 according to the embodiment 3 in contact with the intermediate transfer belt 125 is 4716000 mm. Therefore, the impact rate of the cleaning operation of the fur brush 71 on the life span of all the photoconductor drums 121 according to the embodiment 3 is calculated as 2.9%.

As described above, the configuration according to the embodiment 1 completely prevents the life span of three of the photoconductor drums (C drum, M drum, Y drum), other than the Bk drum, from being shortened by the cleaning operation of the fur brush 71. Accordingly, the configuration according to the embodiment 1 significantly suppresses the degradation of the life span caused by the cleaning operation of the fur brush 71, compared with the comparative example 2 configured to perform the cleaning operation of the fur brush 71 with all the photoconductor drums (C drum, M drum, Y drum, and Bk drum) disposed in contact with the intermediate transfer belt 125. Further, the configuration according to the embodiment 3 significantly suppresses the degradation of the life span of all the photoconductor drums (C drum, M drum, and Y drum) caused by the cleaning operation of the fur brush 71, compared with the comparative example 2 comparative example 2.

[Variation]

The disclosure may be modified in various manners, without limitation to the foregoing embodiments.

For example, although in the foregoing embodiments the operation controller 101 is configured to compare the count value with the cleaning mode starting threshold to thereby perform the cleaning mode when the count value C reaches the threshold, different arrangements may be adopted. The operation controller 101 may perform the cleaning mode upon receipt of an instruction to clean the fur brush 71, from a user or a service person.

The operation controller 101 may control the collection bias applying unit (power source unit) 722 so as to apply to the fur brush 71, in the cleaning mode, a bias stronger than the bias applied thereto in the image forming operation. Applying thus the bias lager than the bias applied in the image forming operation, in addition to rotating the fur brush 71 at a rotation speed higher than the rotation speed thereof in the, enables the fur brush 71 to be cleaned with increased efficiency and effectiveness.

Although the embodiment 1 represents the case where the toner discharged from the fur brush 71 is collected by the toner collection device 128 of the image forming unit 12 in addition to the collection with the cleaning device 70, the toner discharged from the fur brush 71 may be collected solely by the toner collection device 128 of the image forming unit 12, without activating the collection roller 72 and the toner conveying screw 76 of the cleaning device 70.

Further, the photoconductor drums 121 are spaced from the intermediate transfer belt 125 when the fur brush 71 is cleaned, in the foregoing embodiments. In this process, the operation controller 101 may drive the photoconductor drum 121 at a rotation speed lower than the normal rotation speed in the image forming operation. Alternatively, the operation controller 101 may stop the photoconductor drum 121. Even when the photoconductor drum 121 is driven at the normal rotation speed in the image forming operation, the degradation of the photoconductor drum 121 due to frictional wear of the surface can be suppressed compared with the case where the photoconductor drum 121 is kept in contact with the intermediate transfer belt 125. However, driving the photoconductor drum 121 at a rotation speed lower than the normal rotation speed in the image forming operation, or stopping the photoconductor drum 121 enables the degradation of the photoconductor drum 121 due to frictional wear of the surface to be more effectively prevented.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. An image forming apparatus comprising:

an image forming unit including a photoconductor drum, and configured to form a toner image on an outer circumferential surface of the photoconductor drum;

an intermediate transfer belt disposed so as to oppose the photoconductor drum, so that when the intermediate transfer belt is in contact with the photoconductor drum the toner image is transferred from the photoconductor drum onto an outer surface of the intermediate transfer belt;

a brush roller that collects toner remaining on the outer surface of the intermediate transfer belt after the toner image is transferred from the intermediate transfer belt to a recording sheet;

a first power source unit that applies a bias of a reverse polarity to a normal charge polarity of the toner to the brush roller;

a charging device located upstream of the brush roller in a running direction of the intermediate transfer belt;

a charge bias applying unit that applies a bias of a same polarity as the normal charge polarity of the toner to the charging device;

a drive mechanism configured to drive the photoconductor drum, the intermediate transfer belt, and the brush roller;

a contact control mechanism configured to switch the photoconductor drum and the intermediate transfer belt to a non-contact phase from a contact phase; and an operation control unit configured to: perform a cleaning mode including cleaning the brush roller while an image forming operation is not being performed; cause the contact control mechanism to set the photoconductor drum and the intermediate transfer belt to the non-contact phase in the cleaning mode; and cause the drive mechanism, while the photoconductor drum and the intermediate transfer belt are in the non-contact phase, to drive the brush roller to rotate at a rotation speed higher than a rotation speed of the brush roller in the image forming operation, and drive the intermediate transfer belt, wherein the image forming apparatus in the cleaning mode is configured to: drive the brush roller to rotate at the rotation speed higher than the rotation speed of the brush roller and discharge the toner accumulated in the brush roller from the brush roller; apply, from the charging device, a charge of the same polarity as the normal charge polarity to the discharged toner by the bias of the same polarity as the normal charge polarity that is applied by the charge bias applying unit; and, thereafter, electrically adsorb and collect the discharged toner to the brush roller by the bias of the reverse polarity to the normal charge polarity that is applied by the first power source unit.

2. The image forming apparatus according to claim 1, wherein the image forming unit includes a plurality of photoconductor drums, and the operation control unit is configured to cause the contact control mechanism, in the cleaning mode, to set at least one of the plurality of photoconductor drums to the non-contact phase with respect to the intermediate transfer belt.

3. The image forming apparatus according to claim 2, wherein the image forming unit includes: a plurality of transfer rollers disposed so as to oppose each of the plurality of photoconductor drums respectively via the intermediate transfer belt; a plurality of second power source units that apply a bias to each of the plurality of transfer rollers; and a plurality of toner collection units that collects the toner remaining on each of the outer circumferential surfaces of the plurality of photoconductor drums, and the operation control unit is configured to: cause the contact control mechanism, in the cleaning mode, to set at least one of the plurality of photoconductor drums to the non-contact phase with respect to the intermediate transfer belt and set at least another one of the photoconductor drums to the contact phase with the intermediate transfer belt; cause the drive mechanism, with the at least one photoconductor drum spaced from the intermediate transfer belt and the at least another photoconductor drum disposed in contact with the intermediate transfer belt, to drive the brush roller to rotate at a rotation speed higher than a rotation speed of the brush roller in the image forming operation and drive the intermediate transfer belt; and the operation control unit is further configured to: cause the second power source unit to apply the bias of the reverse polarity to the normal charge polarity of the toner, the second power source unit being at least one of the plurality of the second power source units, that applies the bias to the transfer roller disposed so as to oppose the photoconductor drum that is in contact with the intermediate transfer belt and in addition to the collection with the brush roller, and cause the toner discharged from the brush roller to migrate to the outer circumferential surfaces of the photoconductor drums using the bias of the reverse polarity to the normal charge polarity to collect the discharged toner with the toner collection units.

4. The image forming apparatus according to claim 3, further comprising:

a collection roller disposed in contact with an outer circumferential surface of the brush roller so as to collect, from the brush roller, the toner caught by the brush roller; and a cleaning blade disposed in contact with an outer circumferential surface of the collection roller so as to scrape off the toner collected by the collection roller, wherein the first power source unit is connected to the collection roller, and the brush roller receives a bias of the reverse polarity to the normal charge polarity of the toner, through the collection roller.

5. The image forming apparatus according to claim 3, wherein the operation control unit is configured to cause the first power source unit to apply to the brush roller, in the cleaning mode, a bias stronger than a bias applied to the brush roller by the first power source unit in the image forming operation.

6. The image forming apparatus according to claim 2, further comprising a first power source unit that applies a bias of a reverse polarity to a normal charge polarity of the toner to the brush roller, wherein the brush roller collects the toner remaining on the outer surface of the intermediate transfer belt by electric adsorption using the bias applied by the first power source unit, the image forming unit includes: a transfer roller disposed so as to oppose the photoconductor drum via the intermediate transfer belt; a second power source unit that applies a bias to the transfer roller; and a toner collection unit that collects the toner remaining on the outer circumferential surface of the photoconductor drum, and the operation control unit is configured to: cause the contact control mechanism, in the cleaning mode, to set all of the plurality of photoconductor drums to the non-contact phase with respect to the intermediate transfer belt; cause the drive mechanism, with all the photoconductor drums spaced from the intermediate transfer belt, to drive the brush roller to rotate at a rotation speed higher than a rotation speed of the brush roller in the image forming operation; cause the contact control mechanism to set at least one of the plurality of photoconductor drums to the contact-phase with the intermediate transfer belt after driving the brush roller to rotate; cause the drive mechanism, with the at least one photoconductor drum disposed in contact with the intermediate transfer belt, to drive the intermediate transfer belt; and cause the second power source unit to apply a bias of the reverse polarity to the normal charge polarity of the toner.

7. The image forming apparatus according to claim 6, wherein the drive mechanism is configured to drive the intermediate transfer belt and the brush roller in linkage with each other, and the intermediate transfer belt is driven by the drive mechanism, in the cleaning mode, at a first circumferential speed higher than a circumferential speed of the intermediate transfer belt in the image forming operation in linkage with the rotation of the brush roller, with all of the plurality of photoconductor drums spaced from the intermediate transfer belt, and driven by the drive mechanism under control of the operation control unit, at a second circumferential speed lower than the first circumferential speed, with at least one of the plurality of photoconductor drums disposed in contact with the intermediate transfer belt.

8. The image forming apparatus according to claim 1, wherein the operation control unit is configured to count, after performing the cleaning mode, the number of recording sheets subjected to the image forming operation, and perform the cleaning mode when the number of recording sheets reaches a predetermined number, and while the image forming operation is not being performed.

* * * * *